US005730839A

United States Patent [19]

Wendt et al.

[11] Patent Number: 5,730,839

[45] Date of Patent: Mar. 24, 1998

[54] METHOD OF CREPING TISSUE WEBS CONTAINING A SOFTENER USING A CLOSED CREPING POCKET

[75] Inventors: Greg Arthur Wendt, Neenah; Gary Vance Anderson, Larsen; Kelly Steven Lehl, Appleton; Stephen John McCullough, Fond du Lac; Wen Zyo Schroeder, Appleton, all of Wis.

[73] Assignee: Kimberly-Clark Worldwide, Inc., Neenah, Wis.

[21] Appl. No.: 505,572

[22] Filed: Jul. 21, 1995

[51] Int. Cl.[6] ..... B21F 1/12; D21H 17/07; D21H 17/13; D21H 17/55

[52] U.S. Cl. ..... 162/111; 162/168.2; 162/164.4; 162/112; 162/158; 162/166

[58] Field of Search ..... 162/111, 112, 162/158, 164.4, 168.1, 168.2, 166; 428/212, 284, 289, 297, 298, 535, 131, 152; 524/503

[56] References Cited

U.S. PATENT DOCUMENTS

| | | | |
|---|---|---|---|
| 22,362 | 12/1858 | Glynn | 167/84 |
| 302,073 | 7/1884 | Wheeler | 167/84 |
| 967,688 | 8/1910 | Titherley | 167/84 |
| 2,251,328 | 5/1941 | Ehret | 252/134 |
| 2,874,074 | 2/1959 | Johnson | 117/139.5 |
| 2,926,116 | 2/1960 | Keim | 162/164 |
| 2,957,003 | 10/1960 | Johnson | 260/309.6 |
| 3,058,873 | 10/1962 | Keim | 162/164 |
| 3,138,533 | 6/1964 | Heim et al. | 167/84 |
| 3,227,614 | 1/1966 | Scheuer | 167/84 |
| 3,244,724 | 4/1966 | Guttmann | 260/309.6 |
| 3,264,188 | 8/1966 | Gresham | 167/84 |
| 3,395,708 | 8/1968 | Hervey et al. | 128/284 |
| 3,489,148 | 1/1970 | Duncan et al. | 128/284 |
| 3,499,823 | 3/1970 | Croon et al. | 162/158 |
| 3,585,998 | 6/1971 | Hayford et al. | 128/284 |
| 3,632,396 | 1/1972 | Perez-Zamora | 117/76 P |
| 3,640,841 | 2/1972 | Winslow et al. | 162/191 |
| 3,703,481 | 11/1972 | Barker et al. | 252/546 |
| 3,814,096 | 6/1974 | Weiss et al. | 128/268 |
| 3,817,827 | 6/1974 | Benz | 162/113 |
| 3,896,807 | 7/1975 | Buchalter | 128/261 |
| 4,112,167 | 9/1978 | Dake et al. | 428/154 |
| 4,117,187 | 9/1978 | Adams et al. | 428/286 |
| 4,134,840 | 1/1979 | Minegishi et al. | 252/8.9 |
| 4,144,122 | 3/1979 | Emanuelsson et al. | 162/158 |
| 4,158,594 | 6/1979 | Becker et al. | 162/112 |
| 4,300,981 | 11/1981 | Carstens | 162/109 |
| 4,304,625 | 12/1981 | Grube et al. | 162/111 |
| 4,432,834 | 2/1984 | Whitfield et al. | 162/158 |
| 4,439,335 | 3/1984 | Burns | 252/8.75 |
| 4,441,962 | 4/1984 | Osborn, III | 162/158 |
| 4,448,638 | 5/1984 | Klowak | 162/158 |
| 4,458,080 | 7/1984 | Boehmke et al. | 548/354 |
| 4,482,429 | 11/1984 | Klowak | 162/158 |
| 4,501,640 | 2/1985 | Sorens | 162/111 |
| 4,528,316 | 7/1985 | Soerens | 524/503 |
| 4,550,035 | 10/1985 | Smith | 427/308.1 |
| 4,559,157 | 12/1985 | Smith et al. | 252/90 |
| 4,560,599 | 12/1985 | Regen | 428/36 |
| 4,613,447 | 9/1986 | Hara et al. | 252/91 |
| 4,615,937 | 10/1986 | Bouchette | 428/288 |
| 4,622,168 | 11/1986 | Whittlinger | 252/352 |
| 4,623,339 | 11/1986 | Ciraldo | 128/287 |
| 4,684,439 | 8/1987 | Soerens | 162/111 |

(List continued on next page.)

FOREIGN PATENT DOCUMENTS

| | | | |
|---|---|---|---|
| 222459 | 6/1959 | Australia . | |
| 13167/92 | 6/1994 | Australia . | |
| 866298 | 8/1978 | Belgium . | |
| 912213 | 10/1972 | Canada . | |
| 116512A | 8/1984 | European Pat. Off. . | |
| 132128A | 1/1985 | European Pat. Off. . | |
| 0 688 901 A2 | 12/1995 | European Pat. Off. | D21H 21/22 |
| 1118781 | 12/1961 | Germany . | |
| 024811A | 2/1987 | Germany . | |
| 63-023976 | 1/1988 | Japan . | |
| 406016684 | 1/1994 | Japan . | |
| 406136128 | 5/1994 | Japan . | |
| 1288021 | 9/1972 | United Kingdom . | |
| 1407134 | 9/1975 | United Kingdom . | |
| 2033751 | 5/1980 | United Kingdom . | |
| 2121449 | 5/1982 | United Kingdom . | |
| 82/00485 | 2/1982 | WIPO . | |
| 9405720 | 9/1993 | WIPO . | |

OTHER PUBLICATIONS

Oliver, John F., "Dry–creping of Tissue Paper: A Review of Basic Factors," *Tappi Journal*, vol. 63, No. 12, Dec. 1980, pp. 91–95.

Patent Cooperation Treaty Search Report from the International Search Authority, International Application No. PCT/US96/11720 dated Dec. 4, 1996.

Imperante, J., O'Lenick, Jr., A. and Hannon, J. *Silicone Phosphobetaines*, Cosmetics & Toiletries, vol. 190, Mar. 1994, pp. 81–86.

Beran, R. L., *The Evaluation and Selection of Forming Fabrics*, Tappi, vol. 62, No. 4, Apr. 1979, pp. 39–44.

*Primary Examiner*—Donald E. Czaja
*Assistant Examiner*—Jose S. Fortuna
*Attorney, Agent, or Firm*—Gregory E. Croft

[57] ABSTRACT

The invention consists of soft, bulky tissue products that result from the presence of a debonder/softening agent in the outer layers of the tissue and creping under "closed" pocket conditions. The debonder/softening agents belong to a group of organic chemicals that include several imidazolinium quaternary compounds. These chemicals do not adversely interfere with adhesion, unlike most debonders, to the drying surface of the tissue machine. They can, therefore, be placed in the outer layers of the tissue that contact the dryer surface and improve creping. The tissue can then be creped off of the drying surface using a closed pocket, that is a pocket angle of less than 80 degrees. The closed pocket creping normally produces a thicker, less dense tissue but with coarse crepe. Closed pocket creping and the presence of most debonders in the dryer side layers would be expected to also produce coarse crepe structures. However, the interaction of debonder adhesive properties and the closed pocket creping conditions produces a bulky tissue with sufficiently fine crepe structure that results in high overall softness.

15 Claims, 5 Drawing Sheets

U.S. PATENT DOCUMENTS

| | | | |
|---|---|---|---|
| 4,720,383 | 1/1988 | Drach et al. | 424/70 |
| 4,725,489 | 2/1988 | Jones et al. | 428/289 |
| 4,735,860 | 4/1988 | Mizobuchi et al. | 428/423.1 |
| 4,766,015 | 8/1988 | Nikoloff et al. | 427/326 |
| 4,788,243 | 11/1988 | Soerens | 524/503 |
| 4,795,530 | 1/1989 | Soerens et al. | 162/111 |
| 4,817,790 | 4/1989 | Porut et al. | 206/205 |
| 4,855,440 | 8/1989 | Shumway et al. | 548/353 |
| 4,876,355 | 10/1989 | Hughes et al. | 548/352 |
| 4,883,475 | 11/1989 | Bogart et al. | 604/290 |
| 4,894,118 | 1/1990 | Edwards et al. | 162/112 |
| 4,904,524 | 2/1990 | Yoh | 428/311.3 |
| 4,943,350 | 7/1990 | Bogart et al. | 162/158 |
| 5,048,589 | 9/1991 | Cook et al. | 162/109 |
| 5,093,452 | 3/1992 | O'Lenick, Jr. | 528/25 |
| 5,116,520 | 5/1992 | Lichtenwalter et al. | 252/8.6 |
| 5,152,928 | 10/1992 | Kudo et al. | 252/351 |
| 5,160,450 | 11/1992 | Okahara et al. | 252/174.21 |
| 5,164,522 | 11/1992 | McCarthy et al. | 554/39 |
| 5,217,576 | 6/1993 | Van Phan | 162/158 |
| 5,223,628 | 6/1993 | Whittlinger | 548/349.1 |
| 5,225,047 | 7/1993 | Graef et al. | 162/9 |
| 5,237,035 | 8/1993 | O'Lenick, Jr. et al. | 528/27 |
| 5,240,562 | 8/1993 | Van Phan et al. | 162/158 |
| 5,246,545 | 9/1993 | Ampulski et al. | 162/112 |
| 5,264,082 | 11/1993 | Phan et al. | 162/158 |
| 5,284,650 | 2/1994 | Whittlinger | 424/70 |
| 5,326,434 | 7/1994 | Carevic et al. | 162/111 |
| 5,334,286 | 8/1994 | Van Phan et al. | 162/158 |
| 5,348,620 | 9/1994 | Hermans et al. | 162/9 |
| 5,352,817 | 10/1994 | McCarthy et al. | 556/423 |
| 5,382,323 | 1/1995 | Furman, Jr. et al. | 162/111 |
| 5,385,642 | 1/1995 | Van Phan et al. | 162/112 |
| 5,389,204 | 2/1995 | Ampulski | 162/135 |
| 5,397,435 | 3/1995 | Ostendorf et al. | 162/112 |
| 5,399,241 | 3/1995 | Oriaran et al. | 162/112 |
| 5,405,502 | 4/1995 | Phan et al. | 162/127 |
| 5,427,697 | 6/1995 | Swartley | 252/8.8 |

CREPING GEOMETRY

METHOD OF CREPING TISSUE WEBS CONTAINING A SOFTENER USING A CLOSED CREPING POCKET

BACKGROUND OF THE INVENTION

The use of debonders/softening agents in facial and bath tissue is a common practice in the industry. It has been shown that adding such chemicals to the wet end of a tissue machine reduces adhesion to the drying surface. Soerens et el. in U.S. Pat. No. 4,795,530 teach that quaternary amines interfere with the adhesive/release combination normally employed for proper adhesion prior to the drying and creping process. Oriaran et el. in U.S. Pat. No. 5,399,241 teach that these same chemicals cause runnability problems by recirculation in the whitewater system. Both of the aforementioned patents teach that spraying of such chemicals onto the sheet after the web is formed and partially dried is a method of avoiding these problems. It is our experience that softening agents soften by interfering with fiber to fiber bonding. It is also our experience that most softening agents do reduce dryer adhesion as was described by Soerens and Oriaran. The reduced adhesion results in less efficient sheet break-up and coarser creping. This reduction in sheet break-up as demonstrated by the coarser crepe takes away from the total softness of the tissue, which is contrary to the purpose for which the softener was added.

It has also been shown that fine crepe and soft tissue result from creping pocket angles between 80 and 90 degrees. U.S. Pat. No. 4,300,981 to Carstens shows this in its examples. Angles less than 80 degrees are considered "closed" and are known to reduce sheet break-up if adhesion is not increased. This also results in the generation of coarse crepe.

SUMMARY OF THE INVENTION

It has now been discovered that an especially soft tissue can be produced using a closed creping pocket if the appropriate softening agent is used. More specifically, this invention allows the wet end addition of certain softening agents which do not adversely interfere with the adhesion of the tissue to the drying surface coated with the creping adhesive. Because of the chemical nature of the softeners used in this invention, a creped tissue having a combination of low density and surface smoothness can be achieved. The low density is derived from closed pocket creping and the surface smoothness is derived from adequate adhesion to the drying surface.

Hence, in one aspect, the invention resides in a method of creping a dried tissue web comprising: (a) spraying a creping adhesive onto the surface of a rotating creping cylinder (Yankee dryer), said creping adhesive comprising a mixture of an aqueous polyamide resin and a cationic oligomer, such as a quaternized polyamido amine; (b) adhering the tissue web to the surface of the creping cylinder, said tissue web containing an imidazolinium quaternary compound having the following structural formula:

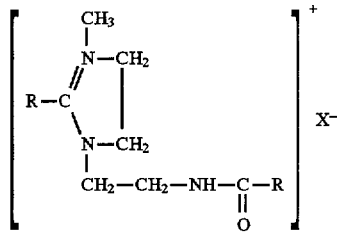

wherein X=methyl sulfate or any other compatible anion; and

R=aliphatic, normal, saturated or unsaturated, $C_8$–$C_{22}$; and (c) dislodging the tissue web from the creping cylinder by contact with a doctor blade positioned against the surface of the creping cylinder and presenting to the web a creping pocket angle of about 78° or less, more specifically from about 70° to 78°, and still more specifically from about 75° to 78°, said tissue web having a moisture content of about 2.5 weight percent or less prior to contacting the doctor blade.

In another aspect, the invention resides in a tissue made by the method described above.

The creping adhesive useful for purposes of this invention comprises a mixture of an aqueous polyamide resin and a cationic oligomer, such as a quaternized polyamido amine. The amount of the polyamide resin in the creping adhesive formulation can be from about 10 to about 80 dry weight percent, more particularly from about 20 to about 40 dry weight percent. The amount of the cationic oligomer in the creping adhesive formulation can be from about 5 to about 50 dry weight percent, more specifically from about 10 to about 30 dry weight percent. Optionally, the creping adhesive can further comprise polyvinyl alcohol, suitably in an amount of from about 20 to about 80 dry weight percent, and more particularly from about 40 to about 60 dry weight percent.

Suitable aqueous polyamide resins are thermosetting cationic polyamide resins as described in U.S. Pat. No. 4,528,316 issued Jul. 9, 1985 to Soerens entitled "Creping Adhesives Containing Polyvinyl Alcohol and Cationic Polyamide Resins", which is herein incorporated by reference. The polyamide resin component of the creping adhesive comprises a water-soluble polymeric reaction product of an epihalohydrin, preferably epichlorohydrin, and a water-soluble polyamide having secondary amine groups derived from a polyalkylene polyamine and a saturated aliphatic dibasic carboxylic acid containing from about 3 to about 10 carbon atoms. The water-soluble polyamide reactant contains recurring groups of the formula $$—NH(C_nH_{2n}HN)_x—CORCO—$$

wherein n and x are each 2 or more and R is the divalent hydrocarbon radical of the dibasic carboxylic acid. An essential characteristic of the resulting cationic polyamide resins is that they are phase-compatible with the polyvinyl alcohol in the creping adhesive; i.e., they do not phase-separate in the presence of aqueous polyvinyl alcohol.

The preparation of the polyamide resin component useful for purposes of this invention is more fully described in U.S. Pat. No. 2,926,116 issued to Gerald I. Keim on Feb. 23, 1960, and U.S. Pat. No. 3,058,873 issued to Gerald I. Keim et al. on Oct. 16, 1962, both of which are herein incorporated by reference. Although both of these patents teach only the use of epichlorohydrin as the reactant with the polyamide, any epihalohydrin is believed to be useful for purposes of this invention since all epihalohydrins should yield a cationic active form of the polyamide resin at the proper pH when reacted with the secondary amine groups of the polyamide.

Suitable commercially available aqueous polyamide resins include Kymene 557 LX (Hercules, Inc.), Quacoat A252 (Quaker Chemical), Unisoft 803 (Houghton International), Crepeplus 97 (Hercules, Inc.), and Cascamid (Borden).

Suitable commercially available quaternized polyamido amines include Quaker 2008M (Quaker Chemical).

The imidazolinium quaternary compound(s) can be added to the tissue making process at any point prior to the creping blade, but is preferably added at the wet end, most preferably added to the thick stock prior to web formation where the consistency of the aqueous papermaking fiber suspension is about 2 percent or greater. The imidazolinium quaternary compound can be added to the papermaking fiber suspension of a blended (non-layered) tissue or a layered tissue. If layered, it is preferred to add the imidazolinium quaternary compound to the furnish of the layer that ultimately contacts the creping cylinder surface. In most cases this is also the layer that is the outwardly-facing layer of the final tissue product that contacts the consumer.

The amount of the imidazolinium quaternary compound in the tissue web can be any amount, more specifically from about 0.05 to about 0.5 dry weight percent based on the dry weight of the fiber in the finished product. Lesser amounts are less effective in providing adequate softness. Greater amounts are less attractive economically.

Suitable imidazolinium quaternary compounds include Varisoft 3590 (commercially available from Witco Corporation) and DPSC 5299-8 (Witco Corporation), which is a quaternary imidazolinium blended with a fatty acid alkoxylate and a polyether with a 200–300 molecular weight.

In addition to the imidazolinium quaternary compound, nonionic surfactants can also be added to the tissue at the wet end of the tissue making process to further enhance the softness of the final product. Examples of useful classes of nonionic surfactants include alkylphenol ethoxylates; aliphatic alcohol ethoxylates (the alkyl chain of the aliphatic alcohol may be either straight or branched, primary or secondary); fatty acid alkoxylates (the fatty acids may be saturated or unsaturated); fatty alcohol alkoxylates; block copolymers of ethylene oxide and propylene oxide; condensation products of ethylene oxide with the product resulting from the reaction of propylene oxide and ethylenediamine; condensation products of propylene oxide with the product of the reaction of ethylene oxide and ethylenediamine; semipolar nonionic surfactants, including water soluble amine oxides; alkylpolysaccharides, including alkylpolyglycosides; and fatty acid amide surfactants. Particularly useful nonionic surfactants are silicone glycols having the following structural formula:

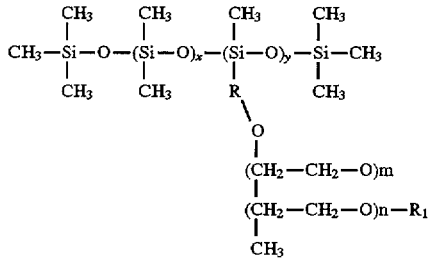

wherein R=alkyl group, $C_1$–$C_8$;

$R_1$=acetate or hydroxyl group;

x=1 to 1000;

y=1 to 50;

m=1 to 30; and n=1 to 30.

The amount of the silicone glycol added at the wet end can be any amount effective in increasing the softness of the tissue, more specifically from about 0.0005 to about 3 dry weight percent based on the amount of fiber in the finished tissue, and still more specifically from about 0.005 to about 1 dry weight percent.

In combination with the silicone glycol and other nonionic surfactants, polyhydroxy compounds can also advantageously included. Examples of useful polyhydroxy compounds include glycerol, and polyethylene glycols and polypropylene glycols having a weight average molecular weight of from about 200 to about 4,000, preferably from about 200 to about 1,000, most preferably from about 200 to about 600. Polylethylene glycols having a weight average molecular weight from about 200 to about 600 are especially preferred.

The moisture content of the dried tissue web prior to contacting the doctor blade can be about 2.5 percent or less, more specifically about 2.0 percent or less, and still more specifically from about 2.0 to about 2.5 percent. Tissue webs to be creped in accordance with the creping method of this invention can be wet-pressed or throughdried tissue webs. In both instances, it is preferable that the creping cylinder be a Yankee dryer, which final dries the web to the desired moisture level prior to creping.

Wet and dry strength additives may also be used within the scope of the present invention. Suitable dry strength agents include, without limitation, polyacrylamide resins and carboxymethyl cellulose. Suitable wet strength additives include both temporary and permanent wet strength additives. Suitable wet strength additives include, without limitation, urea-formaldehyde resins, melamine-formaldehyde resins, epoxidized resins, polyamine-polyamide-epichlorohydrin resins, glyoxalated polyacrylamide resins, polyethyleneimene resins, dialdehyde starch, cationic aldehyde starch, cellulose xanthate, synthetic latexes, glyoxal, acrylic emulsions, and amphoteric starch siloxanes.

DETAILED DESCRIPTION OF THE DRAWINGS

Figure 1:
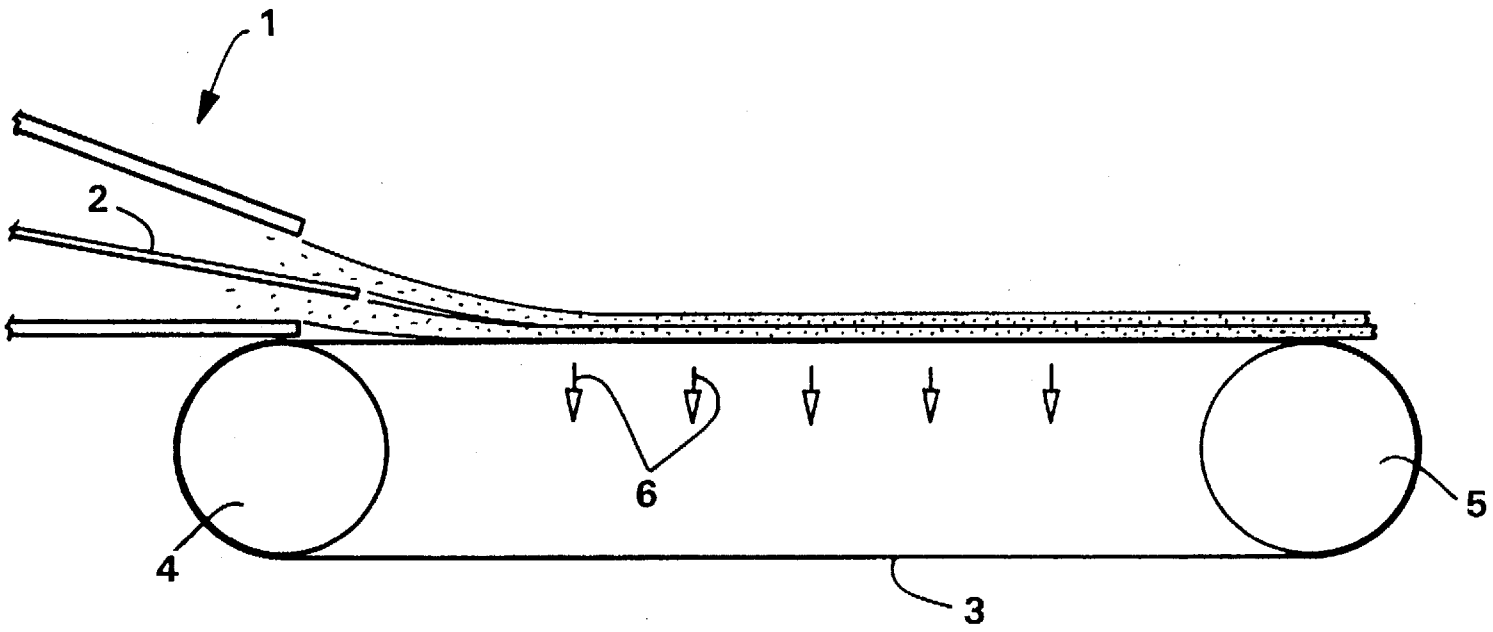
FIG. 1 is a schematic diagram of a layered tissue forming process useful for purposes of this invention.

FIG. 1 is a schematic diagram of a layered forming process illustrating the sequence of layer formation. Shown is a two-layered headbox 1 containing a headbox layer divider 2 which separates the first stock layer (the lower or bottom layer) from the second stock layer (the upper or top layer). The two stock layers each consist of a dilute aqueous suspension of papermaking fibers which can have different consistencies. In general, the consistencies of these stock layers will be from about 0.04 percent to about 1 percent. An endless travelling forming fabric 3, suitably supported and driven by rolls 4 and 5, receives layered papermaking stock issuing from the headbox and retains the fibers thereon while allowing some of the water to pass through as depicted by the arrows 6. In practice, water removal is achieved by combinations of gravity, centrifugal force, and vacuum suction depending on the forming configuration. As shown, the first stock layer is the stock layer which is first to make contact with the forming fabric. The second stock layer (and any successive stock layers if a headbox having more than one divider is utilized) is the second-formed layer and is formed on top of the first layer. As shown, the second stock layer never contacts the forming fabric. As a result, the water in the second and any successive layers must pass through the first layer in order to be removed from the web by passing through the forming fabric. While this situation might be considered to be disruptive of the first layer formation because of all the additional water which is deposited on top of the first stock layer, it has been found that diluting the second and successive stock layers to lower consistencies than that of the first stock layer provides substantial improvements in the formation of the second and successive layers without detriment to the formation of the first layer. The softening agent is added typically to the thick stock before it is diluted. The stock layer to which the agent is added typically is that which contacts the drying surface.

Figure 2:
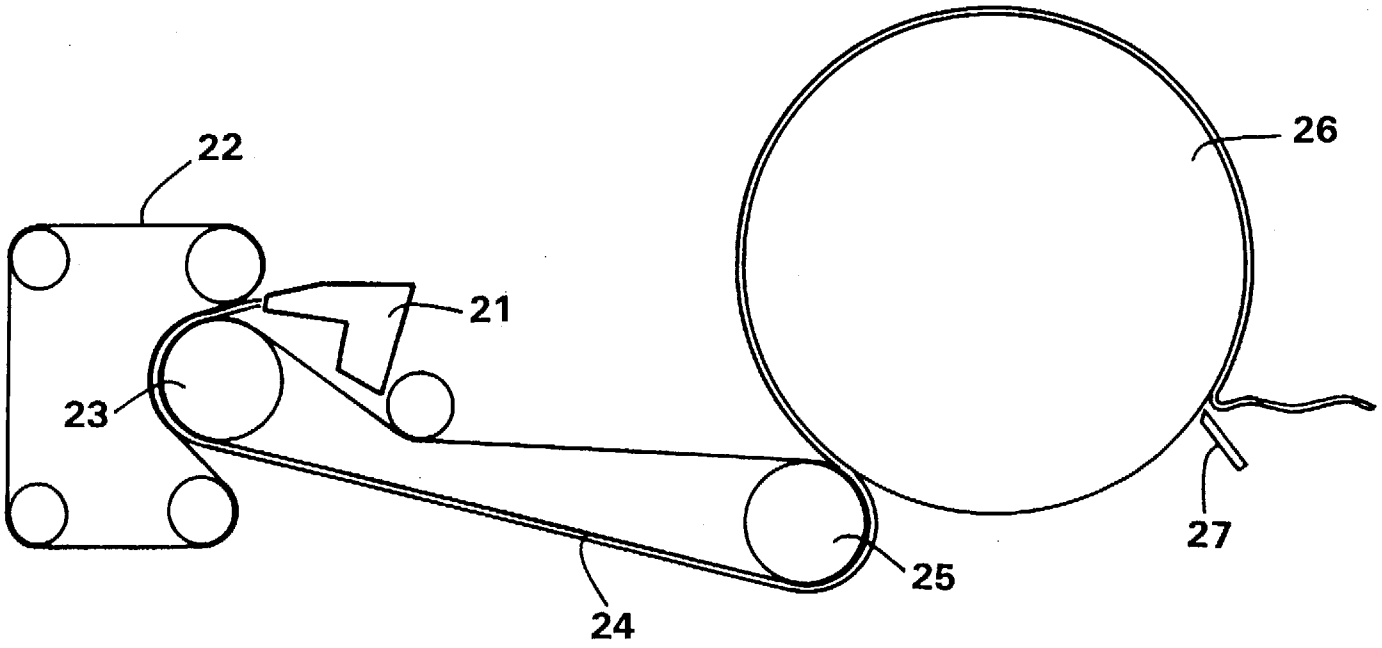
FIG. 2 is a schematic flow diagram of a tissue making process useful for carrying out the method of this invention.

FIG. 2 is a schematic flow diagram of the conventional tissue making process. The specific formation mode illustrated is commonly referred to as a crescent former. Shown is a layered headbox 21, a forming fabric 22, a forming roll 23, a papermaking felt 24, a press roll 25, a Yankee dryer 26, and a creping blade 27. Also shown, but not numbered, are various idler or tension rolls used for defining the fabric runs in the schematic diagram, which may differ in practice. As shown, a layered headbox 21 continuously deposits a layered stock jet between the forming fabric 22 and the felt 24, which is partially wrapped around the forming roll 23. Water is removed from the aqueous stock suspension through the forming fabric by centrifugal force as the newly-formed web traverses the arc of the forming roll. As the forming fabric and felt separate, the wet web stays with the felt and is transported to the Yankee dryer 26.

At the Yankee dryer, the creping chemicals are continuously applied on top of the adhesive remaining after creping in the form of an aqueous solution. The solution is applied by any convenient means, preferably using a spray boom which evenly sprays the surface of the dryer with the creping adhesive solution. The point of application on the surface of the dryer is immediately following the creping doctor 27, permitting sufficient time for the spreading and drying of the film of fresh adhesive.

The wet web is applied to the surface of the dryer by means of a pressing roll with an application force of about 200 pounds per square inch (psi). The incoming wet web is nominally about 10 percent consistency (range from about 8 to about 20 percent) at the time it reaches the pressure roll. Following the pressing or dewatering step, the consistency of the web is at or above about 30 percent. Sufficient Yankee dryer steam power and hood drying capability are applied to this web to reach a final moisture content of 3 percent or less, preferably 2.5 percent or less. The sheet or web temperature immediately preceding the creping blade, as measured by an infra-red temperature sensor with an emissivity of about 0.95, is preferably about 235° F.

Figure 3:
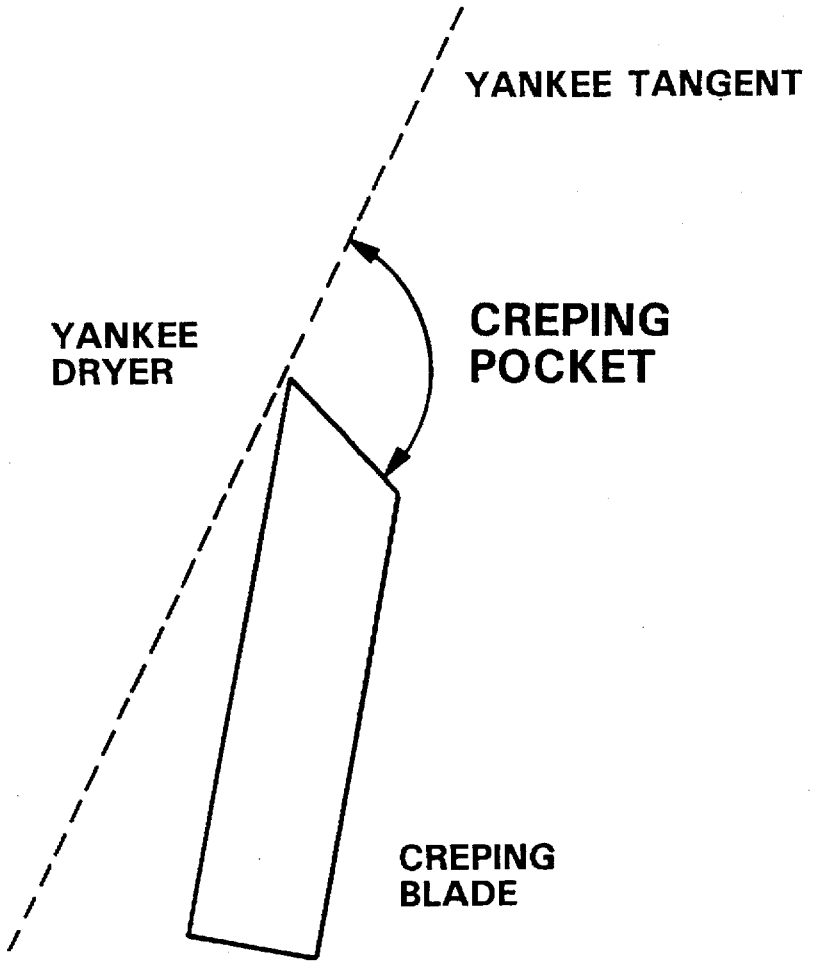
FIG. 3 is a schematic representation of the creping pocket, illustrating the creping geometry.

FIG. 3 is a schematic view of the creping operation, illustrating the creping geometry. The creping pocket, or pocket angle, is formed by the angle between a tangent to the Yankee at the point of contact with the doctor blade and the surface of the doctor blade against which the sheet impacts. The creping pocket angle is schematically indicated by the double arrow and is commonly 80 to 90 degrees. Lower angles cause more energy to be transferred to the tissue web/adhesive sandwich. However, unless adhesion is adequate, the increased energy will cause a failure at the web/adhesive interface resulting in folding of the sheet (as demonstrated by the coarse crepe) rather than compressive debonding which would yield a less dense sheet which should, therefore, be softer. Unexpectedly, the adequate adhesion derived from this invention allows the increased energy derived from closed pocket creping to result in a failure in the adhesive layer itself. This allows the sheet to be compressively debonded, yielding a less dense, softer sheet.

The crepe that results from this invention is not as coarse as is usually seen with closed pocket creping. However, it is also not as fine as described in prior art as measured by a surface profilometer. In fact this crepe structure is a combination of both coarse and fine structures. What is seen when product of this invention is viewed is a fine crepe structure superimposed on an underlying coarse crepe structure. Thus the fine structure confirms the effective break-up of the sheet while the underlying coarse structure enhances the perception of substance. Prior art surface profilometer measurements of products of this invention would place products of this invention outside the range of fine crepe and a soft tissue would not be expected.

Figure 4:
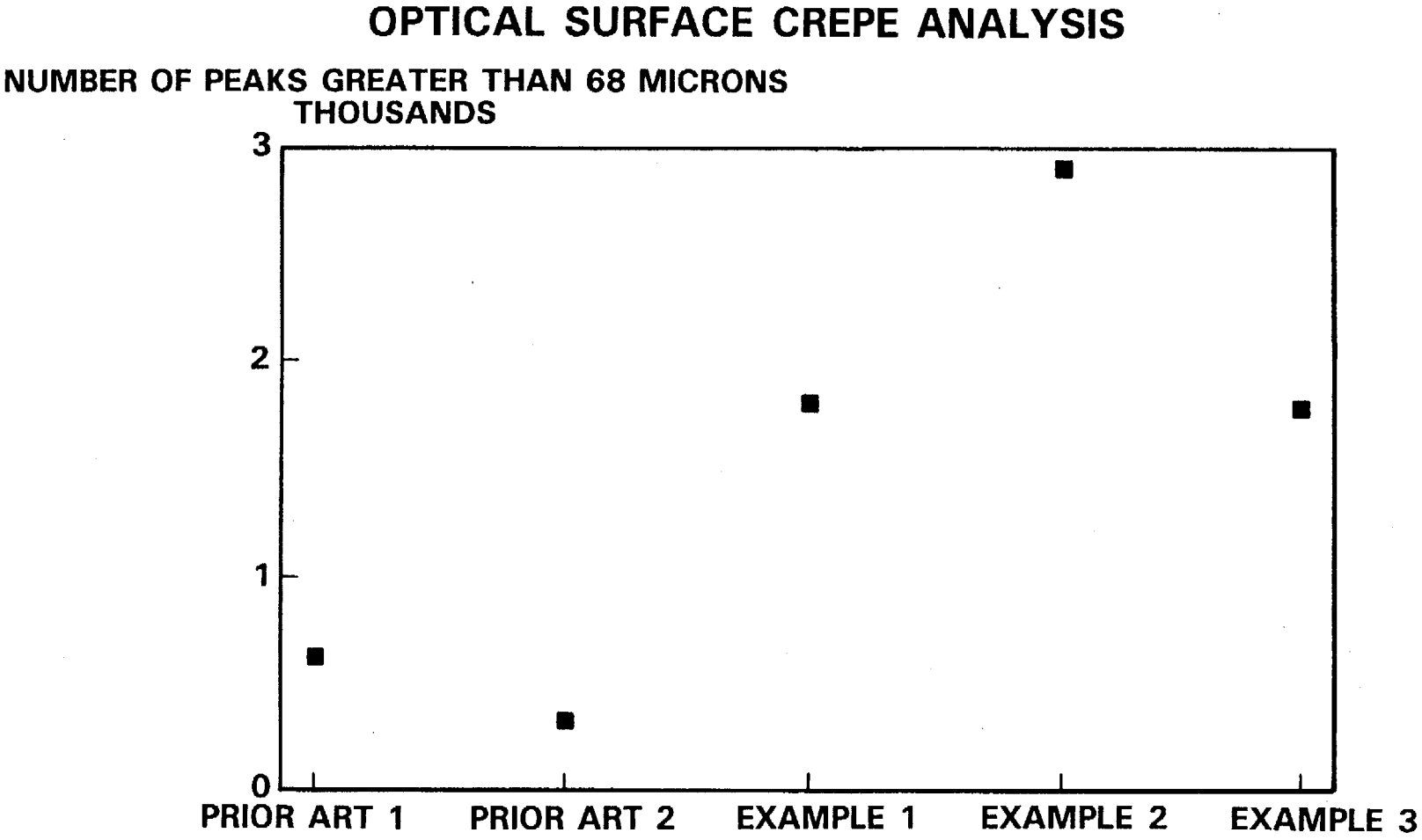
FIG. 4 is a plot of an optical surface crepe analysis of different tissue products comparing the crepe structure of the products of this invention to prior art products.

FIG. 4 shows the results of optical surface crepe measurements, which have been shown to correlate with surface profilometry, that confirm the differences between the Examples of this invention (hereinafter described) and prior art tissues as described in the aforesaid Carstens patent. The optical surface crepe test provides a count of the height of crepe folds as well as the distance between crepe valleys. The output of the test is average crepe height and average distance between crepe valleys. The output also shows the distribution of the count in various size ranges. The total count of peak heights greater than 68.29 microns is shown in FIG. 4. Surprisingly, a consumer sight and handling study showed the tissue of Example 1 was preferred for softness to the tissue of Prior Art 2 by a 63 percent to 37 percent margin. This difference is significant at or above the 95 percent confidence level. Clearly fine crepe is not a prerequisite to soft tissue.

Figure 5:
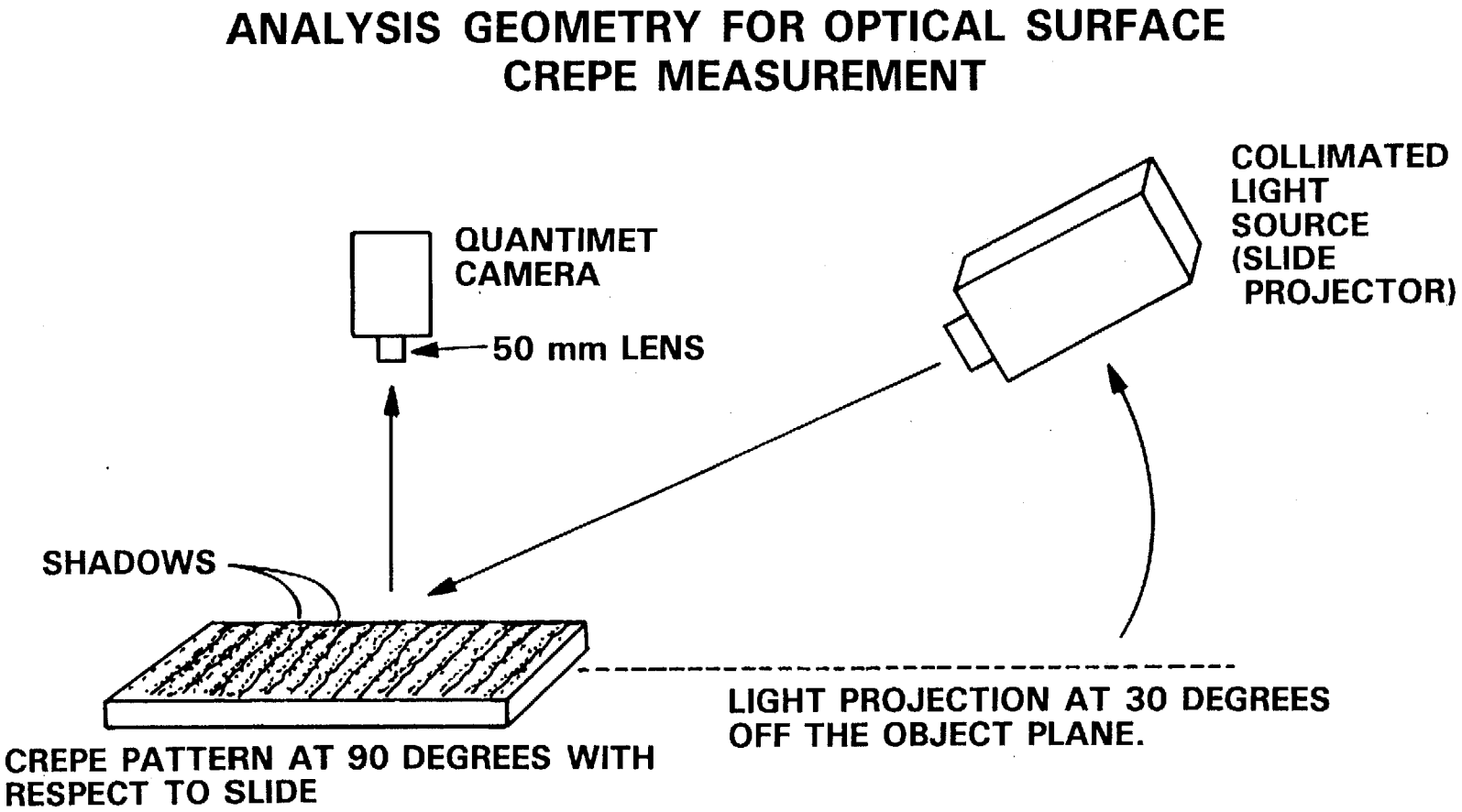
FIG. 5 is a schematic representation of the apparatus used to measure the crepe structure of the tissues for generating the data plotted in FIG. 4.

FIG. 5 is a schematic representation of the apparatus used to measure the crepe structure as will be described below. Shown is the collimated light source (slide projector) which projects the light at a 30° angle off the object plane. The prepared tissue sample is positioned flat on the table top with the crepe pattern aligned at a 90° angle with respect to the light source, resulting in shadows cast by the crepe folds as illustrated by the dotted lines. The reflected light is viewed and analyzed by the Quantimet camera having a 50 millimeter lens.

To measure optical surface crepe using the set-up described in FIG. 5, wrinkle-free tissue samples are mounted on 10×12-inch glass plates by adhering with SCOTCH® tape in corners, and drawing tissue snug under mild tension. One layer is used for bath; two layers (plies) are used for facial. A 5×5 inch patch of tissue is "painted" with a 2/3:1/3 mixture of PENTEL® correction fluid and isopropyl alcohol, using a top quality camel's hair brush and applying in one direction only. A 20 minute drying time is sufficient.

The glass plates with painted tissue are placed on the automacrostage (DCI 12×12 inch) of a Cambridge Quantimet 900 Image Analysis System, under the optical axis of a 50 mm El-Nikkor lens. The sample is illuminated at 30° with a slide projector to form shadows. The software routine "OCREP5" (which is set forth below) is run to perform the analysis. Accurate shading correction and system calibration are performed first. A two-histogram print-out is obtained typically after 15 one-centimeter fields of view are analyzed. The first histogram measures peak heights. The second histogram measures valley distances.

Quantimet 900 Program

```
Cambridge Instruments QUANTIMET 900                QUIPS: VO3.02 USER:
ROUTINE: OCREP5 DATE:                  RUN: 0      SPECIMEN:
    NAME =   OCREP5
    DOES =   Optical crepe analysis providing two histograms:
             one on PEAK HT; the other on PEAK-TO-PEAK distance.
    AUTH =
    DATE =
    COND =   Camb. Macroviewer: Automacrostage; 50 mm EL-NIKKOR lens at f/4; Pole Posn = 42.2 cm
             (check focus); Bell and Howell slide projector, 5 rungs up at 30 des setting; 1/8"
             Posterbd on sts glass; 7 × 9" sample painted with 2/3 PENTEL + 1/3 ISOPROPANOL, taped on
             plate glass 5 inches between macroviewer and table.
             B&H lens to object plane focus paint.
             Working distance = 3' with 40 mm Extension tube, providing
             Field size (Max LIVE FRAME) = 11.6 × 9.09 mm
Enter specimen identity
Scanner (No. 2 Newvicon LV = 0.00 SENS = 1.64
Load Shading Corrector
Catibrate User Specified (Calibration Value = 14.54 microns per pixel)
CALL STANDARD
NO:          = 0
NO:          = 18
TANTHETA:    = 0
TANTHETA:    = 0.57725
LFRAMECNT:   = 0
TOTSCANL:    = 0
Stage Scan   (            X          Y
             scan origin  15000.0    25000.0
             field size   2000       2000
             no of fields 5          3
Detect 2D (Darker than 24 PAUSE)
For FIELD
FRAMEPOSX:  = 0
FRAMEPOSY:  = 0
XPOS:       = 70
YPOS:       = 50
Scanner (No. 2 Newvicon AUTO-SENSITIVITY LV = 0.00)
Live Frame is multiple Rectangle (X:48, Y:36, W:800, H:128)
Image Frame is multiple Rectangle (X:XPOS, Y:YPOS, W:750, H:10)
Detect 2D (Darker than 24)
Amend (OPEN by 2)
Amend (DILATE by 1-Vertically)
Measure feature AREA FERET 0 FERET 90
into array FEATURE (of 700 features and 4 parameters)
FEATURE CALC: = TANTHETA * AREA/FERET90
Distribution of COUNT v CALC from FEATURE in HISTO1
from 20.00 to 2000.0 in 15 bins (LOG)
Amend (SKELETON - Sub mode Peel Ends)
Amend (DILATE by 10 - Vertically)
Image Transfer from Invert A to Binary Output)
Measure feature AREA FERET 0 FERET 90
into array FEATURE (of 600 features and 4 parameters)
FEATURE CALC: = AREA/FERET90
Distribution of COUNT v CALC from FEATURE in HISTO2
from 50.00 to 2000.00 in 15 bins (LOG)
LFRAMCNT: = LFRAMECNT + 1.
Stage Step
Next FIELD
TOTSCANL: = NO * LFRAMECNT * CAL.CONST * I.FRAM.WR / 10000.
Print " "
Print "PEAK HEIGHT HISTOGRAM (UN) - - -"
Print Distribution (HISTO1, differential, bar chart, scale = 0.00)
Print " "
Print " "
Print "VALLEY DISTANCE HISTOGRAM (UM) - - -"
Print Distribution (HISTO2, differential, bar chart, scale = 0.00)
Print " "
Print "TOT FIELDS = ", FIELDNUM, " TOT SCA LENG (cm) = ", TOTSCANL
For LOOPCOUNT = 1 to 6
Print " "
Next
End of Program
```

EXAMPLES

Example 1

A soft tissue product was made using a layered headbox as illustrated in FIG. 1 and using the overall process of FIG. 2. The first stock layer contained eucalyptus hardwood fiber, which made up 60 percent of the sheet by weight. This layer is the first layer to contact the forming fabric. Because it is transferred to a carrier felt, it is also the layer that contacts the drying surface. The second stock layer contained northern softwood kraft. It made up 40 percent of the sheet by weight. An imidazoline softening agent (methyl-1-oleyl amidoethyl-2-oleyl imidazolinium methylsulfate, identified as Varisoft 3690, commercially available from Witco Corporation) was added as a mixture with water at 4 percent solids. The addition rate was 0.2 percent of the fiber in the entire sheet. The addition was made to the eucalyptus thick stock which was at 2.25 percent solids. The basis weight of the sheet was 7.3 pounds per 2880 square feet of air dried tissue. A wet/dry strength agent, Parez 631NC commercially available from Cytec Industries, Inc., was added to the softwood layer as a 6 percent mixture with water. The addition rate was 0.9 percent of the fiber in the entire sheet. It was added to the thick stock which was at 1.14 percent solids. The sheet was formed on a multi-layer polyester fabric with a fiber support index of 261. Fiber support index is a measurement described by R. L. Beran in "The Evaluation and Selection of Forming Fabrics", TAPPI, 62(4), p. 39 (1979). It was transferred to a conventional wet press carrier felt. The water content of the sheet on the felt just prior to transfer to the Yankee dryer was about 88 percent. The sheet was transferred to the Yankee dryer with a vacuum pressure roll. Nip pressure was about 230 pounds per square inch and vacuum equaled 5.5 inch of Mercury. Sheet moisture after the pressure roll was about 53 percent. The adhesive mixture sprayed onto the Yankee surface just before the pressure roll consisted of 40 percent polyvinyl alcohol, 40 percent polyamide resin and 20 percent quaternized polyamido amine. The spray application rate was about 5.5 pounds of dry adhesive per tonne of dry fiber. The creping pocket angle was 78 degrees. A natural gas heated hood partially around the Yankee had a supply air temperature of 533 degrees F. to assist in drying. Sheet moisture after the creping blade was about 2.5 percent. Machine speed of the 24 inch wide sheet was 3000 feet per minute. The crepe ratio was 1.30 or 30 percent. This tissue was plied together and calendered with two steel rolls at 20 pounds per lineal inch. The 2-ply product had the dryer/softener layer plied to the outside. The finished basis weight of the 2-ply tissue at TAPPI standard temperature and humidity was 17.1 pounds per 2880 square feet. The MD tensile was 916 grams per 3 inches and the CD tensile was 461 grams per 3 inches. The thickness of one 2-ply tissue was 0.0097 inches. MD stretch in the finished tissue was 20.8 percent. All tensile tests were at TAPPI conditions. The optical surface crepe value (number of crepe peak heights greater than 68.29 microns) was 1802.

Example 2

This product was made using a layered headbox. The first stock layer contained eucalyptus hardwood fiber. It made up 60 percent of the sheet by weight. This layer is the first layer to contact the forming fabric. Because it is transferred to a carrier felt, it is also the layer that contacts the drying surface. The second stock layer contained northern softwood kraft. It made up 40 percent of the sheet by weight. An imidazoline softening agent (quaternary imidazolinium, fatty acid alkoxylate and polyether with 200–800 molecular weight, identified as DPSC-5299-8, produced by Witco Corporation) was added as a mixture with water at 4 percent solids. The addition rate was 0.17 percent of the fiber in the entire sheet. The addition was made to the eucalyptus thick stock which was at 2.25 percent solids. The basis weight of the sheet was 7.3 pounds per 2880 square feet of air dried tissue. A wet/dry strength agent, Parez 631NC, was added to the softwood layer as a 1 percent mixture with water. The addition rate was 0.06 percent of the fiber in the entire sheet. It was added to the thick stock which was at 1.14 percent solids. The thick stock of the softwood layer was also passed through a disk refiner before the addition of Parez 631NC. The refiner work load was 1.41 Horsepower-days per metric ton of dry fiber. The eucalyptus layer contained a wet strength agent, Kymene 557LX commercially available from Hercules Inc., added at 1.2 pounds per metric ton of dry fiber in the entire sheet. The softwood layer contained a wet strength agent, Kymene 557LX, added at 2.3 pounds per metric ton of dry fiber in the entire sheet. The sheet was formed on a multi-layer polyester fabric with a fiber support index of 241. It was transferred to a conventional wet press carrier felt. The water content of the sheet on the felt just prior to transfer to the Yankee dryer was about 88 percent. The sheet was transferred to the Yankee dryer with a vacuum pressure roll. Nip pressure was about 285 pounds per square inch and vacuum equaled 5.5 inches of Mercury. Sheet moisture after the pressure roll was about 53 percent. The adhesive mixture sprayed onto the Yankee surface just before the pressure roll consisted of 50 percent polyamide resin and 50 percent quaternized polyamido amine. The spray application rate was about 3.9 pounds of dry adhesive per tonne of dry fiber. The creping pocket angle was 78 degrees. A natural gas heated hood partially around the Yankee had a supply air temperature of 675 degrees F. to assist in drying. Sheet moisture after the creping blade was about 2.5 percent. Machine speed of the 24 inch wide sheet was 3000 feet per minute. The crepe ratio was 1.30 or 30 percent. This tissue was plied together and calendered with two steel rolls at 20 pounds per lineal inch. The 2-ply product had the dryer/softener layer plied to the outside. The finished basis weight of the 2-ply tissue at ambient temperature and humidity was 16.9 pounds per 2880 square feet. The MD tensile was 919 grams per 3 inches and the CD tensile was 490 grams per 3 inches. The thickness of one 2-ply tissue was 0.0097 inches. MD stretch in the finished tissue was 21.9 percent. The optical surface crepe value was 2908.

Example 3

This product was made using a layered headbox. The first stock layer contained eucalyptus hardwood fiber. It made up 60 percent of the sheet by weight. This layer was the first layer to contact the forming fabric. Because it is transferred to a carrier felt, it is also the layer that contacts the drying surface. The second stock layer contained northern softwood kraft. It made up 40 percent of the sheet by weight. An imidazoline softening agent (Varisoft 3690) was added as a mixture with water and silicone glycol at 5 percent solids. The silicone glycol is available from Dow Corning Corporation as Dow Corning 190. By weight, the mixture was 4 percent Varisoft 3690 and 1 percent Dow Corning 190. The addition rate was 0.17 percent of the fiber in the entire sheet. The addition was made to the eucalyptus thick stock which was at 2.25 percent solids. The basis weight of the sheet was 7.3 pounds per 2880 square feet of air dried tissue. A wet/dry strength agent, Parez 631NC, was added to the softwood layer as a 1 percent mixture with water. The addition rate was 0.07 percent of the fiber in the entire sheet. It was added to the thick stock which was at 1.14 percent solids. The thick stock of the softwood layer was also passed through a disk refiner before the addition of Parez 631NC. The refiner work load was 1.43 Horsepower-days per metric ton of dry fiber. The eucalyptus layer contained a wet strength agent, Kymene 557LX, which was added at 1.2 pounds per metric ton of dry fiber in the entire sheet. The softwood layer contained a wet strength agent, Kymene 557LX, added at 2.3 pounds per metric ton of dry fiber in the entire sheet. The sheet was formed on a multi-layer polyester fabric with a fiber support index of 241. It was transferred to a conventional wet press carrier felt. The water content of the sheet on the felt just prior to transfer to the Yankee dryer was about 88 percent. The sheet was transferred to the Yankee dryer with a vacuum pressure roll. Nip pressure was about 285 pounds per square inch and vacuum equaled 5.5 inches of Mercury. Sheet moisture after the pressure roll was about 53 percent. The adhesive mixture sprayed onto the Yankee surface just before the pressure roll consisted of 40 percent polyvinyl alcohol, 40 percent polyamide resin and 20 percent quaternized polyamido amine. The spray application rate was about 5.5 pounds of dry adhesive per pound of dry fiber. The creping pocket angle was 78 degrees. A natural gas heated hood partially around the Yankee had a supply air temperature of 680 degrees F. to assist in drying. Sheet moisture after the creping blade was about 2.5 percent. Machine speed of the 24 inch wide sheet was 3000 feet per minute. The crepe ratio was 1.30 or 30 percent. This tissue was plied together and calendered with two steel rolls at 20 pounds per lineal inch. The 2-ply product had the dryer/softener layer plied to the outside. The finished basis weight of the 2-ply tissue at ambient temperature and humidity was 16.9 pounds per 2880 square feet. The MD tensile was 655 grams per 3 inches and the CD tensile was 528 grams per 3 inches. The thickness of one 2-ply tissue was 0.0088 inches. MD stretch in the finished tissue was 18.7 percent. The optical surface crepe value was 1791.

It will be appreciated that the foregoing examples, given for purposes of illustration, are not to be construed as limiting the scope of this invention, which is defined by the following claims and all equivalents thereto.

We claim:

1. A method of creping a dried tissue web comprising:

(a) spraying a creping adhesive onto the surface of a rotating creping cylinder, said creping adhesive comprising a mixture of an aqueous polyamide resin and a quaternized polyamido amine;

(b) adhering the tissue web to the surface of the creping cylinder, said tissue web containing an imidazolinium quaternary compound having the following structural formula:

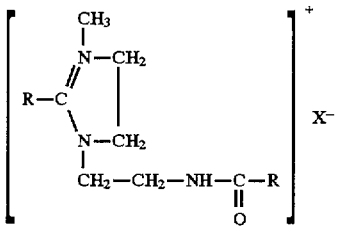

wherein

X=methyl sulfate or other compatible anion; and

R=aliphatic, normal, saturated or unsaturated, $C_8$–$C_{22}$; and (c) dislodging the tissue web from the creping cylinder by contact with a doctor blade positioned against the surface of the creping cylinder and presenting to the web a creping pocket angle of 78° or less, said tissue web having a moisture content of about 2.5 weight percent or less prior to contacting the doctor blade.

2. The method of claim 1 wherein the creping adhesive comprises from about 40 to about 50 dry weight percent polyamide.

3. The method of claim 1 wherein the creping adhesive comprises about 50 dry weight percent polyamide and about 50 dry weight percent quaternized polyamido amine.

4. The method of claim 1 wherein the creping adhesive comprises polyvinyl alcohol.

5. The method of claim 1 wherein the creping adhesive comprises about 40 dry weight percent polyamide, about 20 dry weight percent quaternized polyamido amine, and about 40 dry weight percent polyvinyl alcohol.

6. The method of claim 1 wherein the tissue web contains from about 0.05 to about 0.5 dry weight percent of the imidazolinium quaternary compound.

7. The method of claim 1 wherein the tissue web further comprises a silicone glycol having the following structural formula:

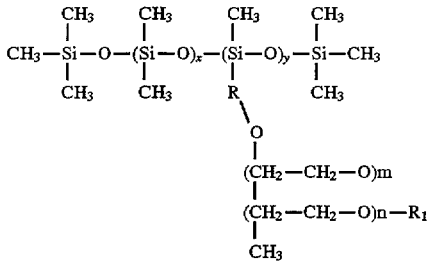

wherein

R=alkyl group, $C_1$–$C_8$;

$R_1$=acetate or hydroxyl group;

x=1 to 1000;

y=1 to 50;

m=1 to 30; and n=1 to 30.

8. The method of claim 1 wherein the creping pocket angle is from about 70° to 78°.

9. The method of claim 1 wherein the tissue web is layered and wherein the imidazolinium quaternary compound is in the layer contacting the creping cylinder.

10. The method of claim 1 wherein the tissue web is wet-pressed.

11. The method of claim 1 wherein the tissue web is throughdried.

12. The method of claim 1 wherein X is methyl sulfate.

13. The method of claim 1 wherein the imidazolinium quaternary compound is blended with a fatty acid alkoxylate and a polyether having a molecular weight of from 200 to 300.

14. The method of claim 1 wherein the tissue web contains a nonionic surfactant.

15. A method of creping a dried tissue web comprising:

(a) spraying a creping adhesive onto the surface of a rotating creping cylinder, said creping adhesive comprising a mixture of an aqueous polyamide resin and a quaternized polyamido amine;

(b) adhering the tissue web to the surface of the creping cylinder, said tissue web containing an imidazolinium quaternary compound having the following structural formula:

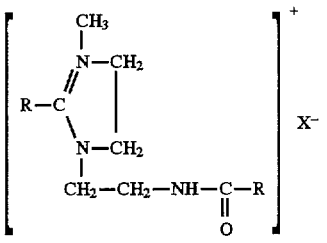

wherein

X=methyl sulfate or other compatible anion; and

R=alipathic, normal, saturated or unsaturated, $C_8$–$C_{22}$; and (c) dislodging the tissue web from the creping cylinder by contact with a doctor blade positioned against the surface of the creping cylinder and presenting to the web a creping pocket angle of from about 75° to about 78°, said tissue web having a moisture content of about 2.5 weight percent or less prior to contacting the doctor blade.

* * * * *